US006382263B2

(12) United States Patent
Dewispelaere

(10) Patent No.: US 6,382,263 B2
(45) Date of Patent: May 7, 2002

(54) HOOK SELECTION DEVICE FOR A SHED-FORMING DEVICE FOR A WEAVING MACHINE

(75) Inventor: André Dewispelaere, Kortrijk/Marke (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 09/811,230

(22) Filed: Mar. 19, 2001

(30) Foreign Application Priority Data

Mar. 17, 2000 (BE) ..... 000203

(51) Int. Cl.[7] ..... D03C 3/20
(52) U.S. Cl. ..... 139/455
(58) Field of Search ..... 139/455

(56) References Cited

U.S. PATENT DOCUMENTS 4,566,499 A * 1/1986 Kitagawa et al. ..... 139/455
5,647,403 A * 7/1997 Willbanks ..... 139/455
5,782,272 A * 7/1998 Dewispelaere ..... 139/455

FOREIGN PATENT DOCUMENTS

DE 3728513 3/1989
DE 283 429 10/1990
EP 0 408 076 1/1991
EP 0 823 501 2/1998

* cited by examiner

*Primary Examiner*—Andy Falik
(74) *Attorney, Agent, or Firm*—James Creighton Wray; Meera P. Narasimhan

(57) ABSTRACT

A hook selection device for a shed-forming device for a weaving machine, in particular for a jacquard machine, has a number of hooks (3), (4) that can be moved up and down by a lifting means (1), (2). For each hook, there is a selection element with which the hook can be selected for being held by a holding element (5), (6) at a selection height. A resetting device (7) exerts a downward directed resetting force on the hook (3), (4), only during the movement on a path of the hook. The resetting device (7) is provided to transmit the resetting force to a contact part (8) of the hook that is lower than the top hook extremity, while each resetting device comprises a pressure device (10), which can be moved upward by a hook (3), (4) against a downward directed spring pressure. With such a hook selection device it is also possible to exert an effective resetting force on non-form-retaining hooks, while the hooks can be easily removable, and while the additional power that is consumed by the device is kept to a minimum.

15 Claims, 1 Drawing Sheet

HOOK SELECTION DEVICE FOR A SHED-FORMING DEVICE FOR A WEAVING MACHINE

BACKGROUND OF THE INVENTION

This invention relates to a device for selecting the hooks of a shed-forming device for a weaving machine, comprising a number of upwardly and downwardly movable hooks and, for each hook, a selection element with which the hook can be selected in order to be held by a holding element at a selection height and a returning means in order to exert a downward directed returning force on a contact part of the hook that is lower than the top hook extremity, only in the course of a part of the movement path of the hook.

This invention also relates to a shed-forming device provided with a number of these selection devices, more specifically a jacquard machine, as well as a weaving machine provided with such a shed-forming device.

When weaving on a weaving machine, in successive operating cycles of the weaving machine, one or several weft yarns are inserted in a shed between warp yarns. The insertion of weft yarns occurs in each case at well-defined weft insertion levels. In the course of the weaving, in each operating cycle, the various warp yarns have to be brought into a predetermined position in relation to each weft insertion level in order to obtain the desired fabric. Devices with which warp yarns can automatically be correctly positioned in the course of weaving on a weaving machine, are generally known. In the claims and the specification of this patent application such a device is called a shed-forming device.

Jacquard machines with which the warp yarns can be positioned individually or in groups in the course of weaving on a weaving machine, are known. A known jacquard machine comprises a number of shed-forming devices with two knives moving up and down in opposite phase that can each engage a series of hooks. For this purpose each hook has a supporting nose that is provided in order to rest on a supporting edge of a knife. This machine furthermore also comprises a number of selection elements with solenoids with which each hook can be brought into a position whereby a hook-shaped projection provided at a fixed height arrives in an opening of the hook, so that this hook remains hanging at a selection height during the further movements of the knives. This hook is then selected. The hook can remain selected during several operating cycles of the knives, but can also be already released on the following movement cycle of the knives by a suitable control of the selection element in question, whereby the hook-shaped projection no longer meshes in the opening of the hook, and whereby the hook again rests with its supporting nose on a knife and moves downward with the knife.

The movements of the hooks can, for example with pulley devices, be transmitted to harness cords, which in their turn are connected to jacquard heddles that can more one or several warp yarns. By selecting hooks or not the jacquard heddles, and therefore also the warp yarns, can be brought into two or more different positions. The selection elements can for example be electronically operated in order at each operating cycle of a weaving machine, to obtain a correct positioning of the warp yarns, through a suitable hook selection.

A jacquard heddle is lifted upward by a jacquard hook that rests on an upward moving knife. When a jacquard heddle has to be brought to a lower situated position a jacquard hook working together therewith will follow the downward movement of a knife. In order to hold each hook on the knife with these up and down movements, each jacquard heddle is connected to a return spring that exerts a downward directed force on the jacquard heddle.

With selection of a hook it is of great importance that the hook is brought to the correct height at the right moment in order to be able to implement this selection without any problem, and that the hook, after implementing the selection, hooks in well on the hook-shaped projection, or, in case of non-selection thereof, moves down again on a knife. The spring force acting on the jacquard heddles often appears to be insufficiently effective for this purpose. A number of devices are known with which it has been attempted to remedy this. These devices have the characteristics that are mentioned in the first paragraph of this specification.

A first known device is the one according to the patent publication DD 283 429. In this device a second return spring is provided for safely bringing the hook to the selection position were for one reason or another the first return spring (that acts on the jacquard heddle) not to do this, e.g. knots entangling in the warp yarns. This device also has the great disadvantage that a second spring has to be compressed over the total lifting height of the hooks. The drive of this device will therefore consume a higher power.

A second device is known from patent publication EP 0 408 076. With this device a pressure bar is provided that only presses on the hooks if these are in the top part (in the vicinity of their top dead point) of their movement path. The weight of the pressure bar is sufficient in order to prevent the hook from leaving the knife upon reaching the top dead point of the movement, and in order to press downward a magnetically attracted hook against the friction, until it hangs on the projection, even were the return force acting on the jacquard heddles have failed entirely. This device has the characteristics mentioned in the first paragraph of this specification but has as disadvantage that the removal of a hook is rather time-consuming and that the device is not suitable for high weaving speeds.

Another solution is known from patent publication EP 0 823 501. This device can only operate with jacquard machines with rather thick-walled form-retaining plastic hooks.

SUMMARY OF THE INVENTION

The purpose of this invention is to provide a hook selection device with which the above described disadvantages are remedied, and with which therefore an operationally safe hook selection can be implemented at relatively high weaving speeds, whereby the hooks are removable, and whereby the hook selection device requires very limited additional power.

In particular by an operationally safe hook selection a selection is meant that is implemented without any problem and continues to be maintained, even were the return force of the jacquard heddle would be reduced temporary or cease entirely.

This purpose is achieved according to this invention by providing a hook selection device with the characteristics mentioned in the first paragraph of this specification, of which each returning device comprises a pressure means that can be moved upwards by a hook against a downward directed spring load.

If a resetting force is exerted on the top hook extremity, a non-form-retaining hook will deform under the influence of this force and the hook selection will fail. By applying a smaller return force the chance of deformation of the hook is reduced but the smaller return force therefore also becomes less effective.

If however the return force makes contact on a lower situated contact part of the hook, the point of application of the return force acting on the hook will lie either at a shorter distance above the supporting nose of the hook or below this supporting nose. The power of the forces acting on a hook—namely the downward directed return force and the upward directed pushing force of the knife on which the hook rests applied to the supporting nose—in order to deform the hook decreases because of this, so that an effective return force can also be acting on non-form-retaining hooks without risk of an undesired deformation of the hook. In contrast to a number of known devices this selection device is therefore very well suited for use with hooks that are not form-retaining. Such hooks are usually made out of metal and are among others used with selection devices that operate with solenoids, whereby the hooks have to be capable of being bent under the influence of a magnetic attractive or repulsive force developed by a solenoid in order to come into a selection position or a non-selection position.

Since the return force only has to be acting during a limited part of the movement path of the hooks, the selection device can be so implemented that the hooks are easily removable. The hooks also only have to be moved during a limited part of their movement path against the return force so that the additional power that is consumed by this device is minimal.

This selection device also ensures a very operationally safe selection. Through the return force the hooks are prevented from leaving the knife at the moment that they can be selected and it is ensured that the holding means provided on the hook is correctly positioned in relation to the holding element. This is especially necessary where the hooks can be selected in the vicinity of the top dead point of their up and down movement. After the selection has been implemented and the holding element in co-operation has come with the holding means provided on the hook (e.g. if the hook is brought into a bent position by the selection element, so that a hook-shaped projection provided at a fixed height latches in a window opening of the hook), the return force ensures that the hook with the downward movement of the knife is pressed downward over a short distance, so that the co-operation between holding element and holding means is improved. Where the holding element and holding means are respectively implemented as a projection and an opening (of vice versa) this results in the correct hooking-up of the hook.

The return force continues to be maintained as long as the hook remains hooked up. A temporary interruption in the downward force exerted on the jacquard heddle will therefore not lead to a hook falling off. When a hook is no longer selected, the returning force will also ensure that the "stick-slip" effect is better overcome and that the hook at least starts to follow the downward movement of the knife.

Once in movement the force acting on the jacquard heddle must be sufficient in order to hold the hook on the knife during the remainder of the downward movement.

Because of the fact that each return device comprises a pressure means, which is upwardly movable by a hook against a downward directed spring pressure, the selection device is very reliable and is less subject to wear and tear than the known devices.

Because of this the device can also operate at a very high speed and the pre-tensioning of the resetting springs in the harness (that exerts a downward directed spring pressure on the jacquard heddles) is reduced. This leads to a saving in the drive power of the jacquard machine.

The hook selection device according to this invention is preferably so implemented that the aforesaid contact part of each hook lies lower than the holding means with which a holding element can work together in order to hold the hook at the selection height. The deforming power of the forces acting on a flexible hook is still further reduced because of this so that the device can work operationally safely with hooks with a great flexibility.

Each return device can be provided for that purpose with a pressure means that, only in the course of the upward movement of this hook, can be moved upward on a top part of its movement path. Because of this the return force is acting on the hooks when these are in the top dead point of their up and down movement. Because of this the hooks are prevented from leaving the knife in that top dead point through their inertia, and not being correctly positioned in relation to the holding element and/or the selection element.

In a preferred embodiment of the hook selection device according to this invention each return device comprises a guide for guiding the pressure means in the course of its up and down movements.

A particularly simple and effective embodiment is obtained if the aforesaid guide comprises a guiding wall that to a great extent encloses the pressure means, while the aforesaid contact part of the hook in the course of the up and down movements of the hook extends inside the guiding space enclosed by the guiding wall, so that the contact part can take the pressure means along upward.

Each return device can for example comprise a spring disposed between the top of the pressure means and an immovable bearing surface that exerts a downward directed spring pressure on the pressure means. This spring is preferably provided in a top part of the guiding space.

The hooks can be of very simple design if the contact part is a lateral projection of the hook that is at the same time provided in order to rest on a lifting means. The hooks need not then be provided with a separate contact part.

Each hook can be so implemented that it comprises a supporting nose that is provided in order to rest on a lifting means, while the contact part of each hook is a(nother) lateral projection of the hook, whereby this supporting nose and this contact means are provided opposite each other on either side of the hook.

Preferably, the hooks are provided in order to be bent under the influence of a force exerted by a selection element.

In a particular embodiment each return device is provided in a lower part of a guide housing for the jacquard hooks. The device is most effective when a return device is provided for each hook.

A shed-forming device, in particular an electronically operated jacquard machine, which is provided with or works together with a hook selection device according to this invention, as well as a weaving machine provided with such a shed-forming device, falls within the scope of protection determined by the claims of this patent application.

In the following detailed specification of an embodiment example of a hook selection device according to this invention the aforesaid characteristics and advantages of the invention are further explained and additional properties and advantages thereof are indicated. The purpose of this specification is only to give a clarifying example of a possible embodiment of this invention and can therefore in no way be interpreted as a restriction on the field of application of the invention or on the patent rights claimed in the claims.

In this specification reference is made by means of reference numbers to the figures attached hereto, of which

DETAILED DESCRIPTION

Figure 1:
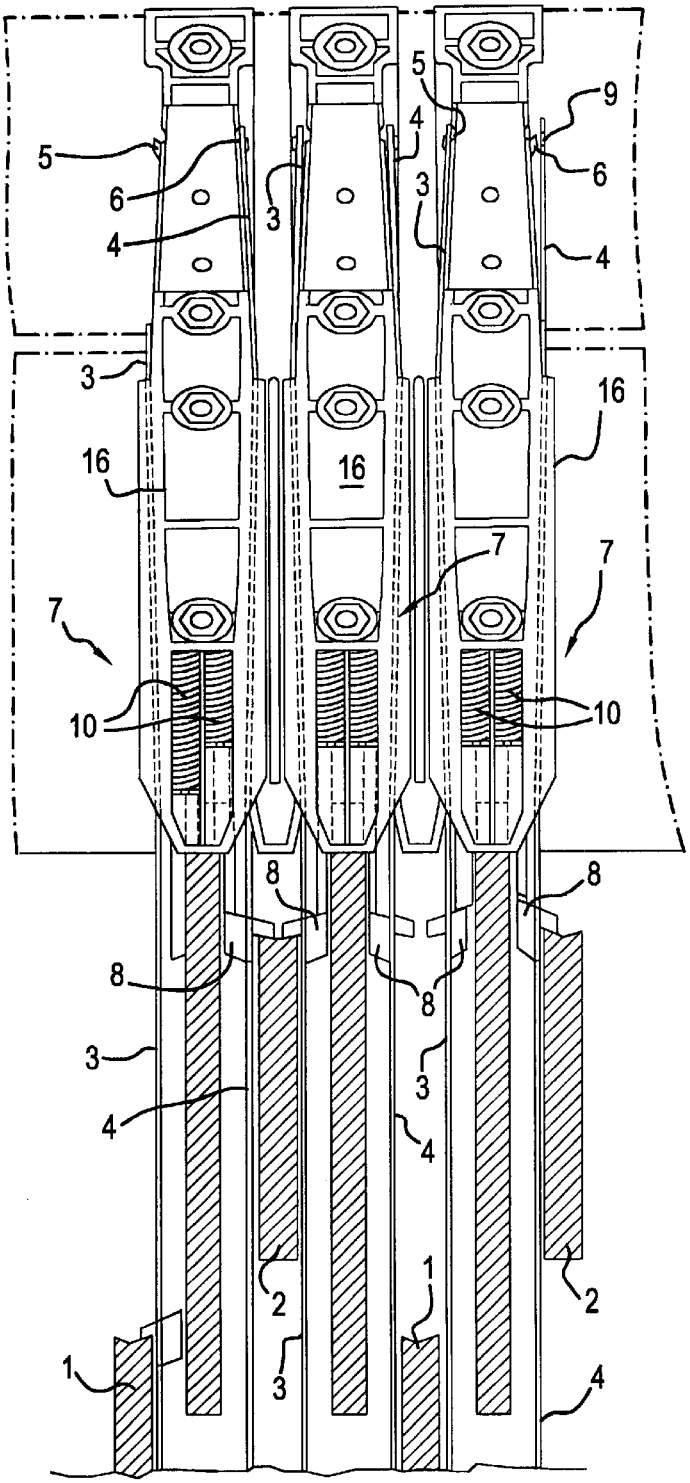
FIG. 1 represents a schematic side elevation of a part of a hook selection device according to this invention.
Figure 2:
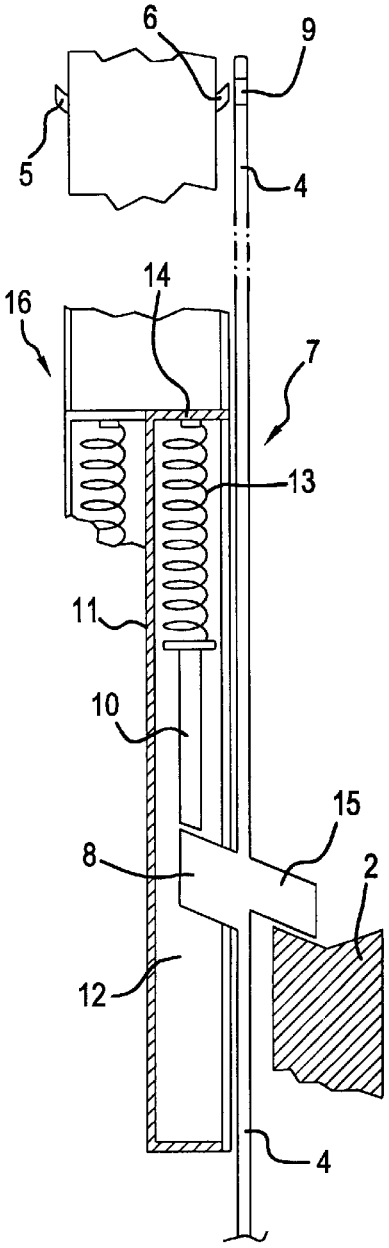
FIG. 2 represents a schematic cross-section of a part of the resetting devices of the selection device represented in FIG. 1.

In a preferred embodiment the hook selection device according to this invention consists of several rows of selection and guiding bodies (16) disposed next to one another, whereby each body (16) is provided on two opposite sides for guiding an up- and down-moving hook (3), (4) and for selecting that hook (3), (4). With each selection and guiding body (16) two opposite hooks (3), (4) therefore work together. The hooks (3), (4) working together with a same row of selection and guiding bodies (16) are consequently disposed in two parallel rows. The hooks of these rows can be engaged by knives (1), (2) moving up and down in opposite phase.

Three selection and guiding bodies (16) of three successive rows and the hooks (3), (4) working together therewith are represented in FIG. 1.

The hooks (3), (4) are thin metal flexible hooks that are in known manner part of shed-forming systems that by means of pulley cords not represented in the figures, and pulley elements working together therewith can automatically bring a jacquard heddle to a number of different levels. These different levels are reached by selecting the hooks (3), (4) or not that belong to such a shed-forming system. The hooks (3), (4) are provided with a window opening (9) on top.

During their up and down movement on the knives (1), (2) the hooks move up and down between the selection and guiding bodies (16) of neighboring rows. In their top dead point they come to stand opposite the top part of their selection and guiding body (16). In this top part two solenoids (not visible in the figures) are provided in order on the respective opposite sides of the selection and guiding body (16) to exert an electromagnetic attractive force on a respective hook. For that purpose pole plates are provided on each side. On these opposite sides the selection and guiding body furthermore also has hook-shaped projections (5), (6) that fit into the window openings (9) of the hooks. A hook (3), (4) raised by a knife (1), (2) can be attracted by the electromagnetic force and be bent against the pole plates, so that the latch (5), (6) arrives in the window opening (9). Because of this the hook (3), (4) is suspended from the latch (5), (6) during the return downward movement of the knife (1), (2). The knife (1), (2) working together with this hook in the meantime carries on moving up and down. In each case when the knife (1), (2) comes into its top dead point, the selection can be terminated by no longer exerting any electromagnetic attractive force on the hook (3), (4), so that the hook again springs away from the pole plates, hooks off the latch (5), (6), and is carried downward by the knife (1), (2).

In a lower part of each selection and guiding body (16) for each hook (3), (4) a return device (7) is provided. For each hook (3), (4) a hollow space (12) is provided in which a pusher (10) and a compression spring (13) acting thereon are provided.

The pusher (10) can slide up and down in the hollow space (12), and is to a great extent enclosed by a guiding wall (11). The compression spring (13) sits between the top fixed wall (14) of the guiding space (12) and the top of the pusher (10).

Each hook (3), (4) is on the one hand provided with a laterally projecting supporting nose (15) with which the hook can rest on a top engagement edge of a knife (1), (2), while on the opposite side of the hook and almost at the same height a similar contact nose (8) is provided with an upwardly inclined top edge. The pusher (10) is provided underneath with a shank with a sloped end face that is complementary to the inclined top edge of the contact nose (8). Along the side of the hook (3), (4) the hollow space (12) is open so that the contact nose (8) can extend into this space (12) in the course of the top part of the movement path of the hook (3), (4) and at the extremity of this upward movement (for example from 1 cm below the top dead point) strikes against the end face of the shank of the pusher (10) and takes the pusher (10) along upward against the downward directed spring pressure. Such a pusher (10) with compression spring (13) is provided for each individual hook (3), (4). Two such return devices (7) are therefore provided next to one another per selection and guiding body (16).

The jacquard hooks that are raised by the lifting knives, come into contact with the shank of the pusher (16) at approximately 1 cm from the top dead point. The compression springs (13) are compressed and this will prevent the hooks (3), (4) from leaving the knife (1), (2) and flying on upon reaching the top dead point. When with selection the solenoid is energized, the hook (3), (4) bends toward the pole plates and remains sticking there as long as the energizing is maintained. Now when the knife (1), (2) moves down and were the return force in the harness cord to operate insufficiently, then the hook (3), (4) remains sticking but is not properly hooked up. The return force of the compression spring (13) on the pusher (10) will indeed overcome the frictions of this hook through which the hook (3), (4) is pushed down until to the window opening (9) in the hook (3), (4) hooks onto the latch (5), (6). This spring pressure on the hook (3), (4) continues to be maintained as long as the hook remains latched above. A temporary interruption in the return force of the jacquard heddle will therefore not lead to a hook falling off. When a hook is not selected in its top position, the compression spring (13) will ensure that the stick-slip effect is better overcome and that the hook at least for the first centimeter correctly follows the downward movement of the knife. Once in movement the resetting force of the harness must be sufficient for the remainder of the downward movement.

Additional advantages of this device are: in the top dead position the hooks can no longer fly on from the knife, the window opening in the hook is better positioned in front of the latch, this gives a more reliable selection with less wear and tear, the hook when selected is correctly pushed onto the latch and held there or the hook is pushed out of its stick-slip position when not selected. Because of this the device can operate at very high speed and the pre-tensioning of the return springs in the harness can be reduced. This leads to saving in the drive power of the jacquard machine.

What is claimed is:

1. Hook selection device for a shed-forming device for a weaving machine, comprising a number of hooks (3), (4) that can be moved up and down by a lifting means (1), (2) and, for each hook, a selection element with which the hook can be selected in order to be held by a holding element (5), (6) at a selection height, a contact part and a returning device (7) in order to enable a downward directed returning force to act on the contact part (8) that is lower than a top hook extremity of the hooks (3), (4), only during a part of a movement path of the hooks, characterized in that each returning device (7) comprises a pressure means (10) that can be moved upward by the hooks (3), (4) against the downward directed force.

2. Hook selection device for a shed-forming device for a weaving machine, according to claim 1 characterized in that the aforesaid contact part (8) lies lower than the holding means (9) with which the holding element (5), (6) can work together in order to hold the hooks (3), (4) at the selection height.

3. Hook selection device for a shed-forming device for a weaving machine, according to claims 1 characterized in that the aforesaid pressure means is adapted to only be moved upwardly during the upward movement of the hooks in a top part of its movement path.

4. Hook selection device for a shed-forming device for a weaving machine, according to claim 1, characterized in that each return device (7) comprises a guide (11) for guiding the pressure means (10) in the course of its up and down movements.

5. Hook selection device for a shed-forming device for a weaving machine, according to claim 4 characterized in that the aforesaid guide comprises a guiding wall (11) that to a great extent encloses the pressure means (10), and that the contact part (8) of the hook (3), (4) in the course of the up and down movements of the hook extends inside the guiding space (12) enclosed by the guiding wall (11), so that the contact part (8) can take the pressure means (10) along upward.

6. Hook selection device for a shed-forming device for a weaving machine, according to claim 1, characterized in that each return device (7) comprises a spring (13) that exerts a downward directed spring load on the pressure means (10), and that the spring (13) is disposed between the top of the pressure means (10) and an immovable bearing surface (14).

7. Hook selection device for a shed-forming device for a weaving machine, according to claim 6 characterized in that the spring (13) is provided in a top part of the guiding space (12).

8. Hook selection device for a shed-forming device for a weaving machine, according to claim 1 characterized in that the contact part (8) of each hook (3), (4) is a lateral projection of the hooks that is also provided in order to rest on a lifting means (1), (2).

9. Hook selection device for a shed-forming device for a weaving machine, according to claim 1 characterized in that each hook (3), (4) comprises a supporting nose (15) that is provided in order to rest on the lifting means (1), (2), that the contact part (8) of each hook is a lateral projection of the hooks (3), (4), and that the supporting nose (15) and the contact part (8) are provided opposite each other on either side of the hooks.

10. Hook selection device for a shed-forming device for a weaving machine, according to claim 1 characterized in that the hooks (3), (4) are adapted for being bent by a force exerted by the selection element.

11. Hook selection device for a shed-forming device for a weaving machine, according to claim 1 characterized in that each returning device (7) is provided in a lower part of a guide housing (16) for the hooks (3), (4).

12. Hook selection device for a shed-forming device for a weaving machine, according to claim 1 characterized in that for each hook (3), (4) a resetting device (7) is provided.

13. Jacquard machine, provided with a hook selection device according to claim 1.

14. Weaving machine provided with a shed-forming device with a hook selection device according to claim 1.

15. Weaving machine provided with a shed-forming device according to claim 14, wherein the weaving machine is an electronically operated jacquard machine.

* * * * *